US006915918B2

(12) United States Patent
Merrill

(10) Patent No.: US 6,915,918 B2
(45) Date of Patent: Jul. 12, 2005

(54) REMOVABLE SEALING DEVICE

(76) Inventor: Richard Merrill, 1643 Coastal Rd., Brooksville, ME (US) 04617

( * ) Notice: Subject to any disclaimer, the term of this patent is extended or adjusted under 35 U.S.C. 154(b) by 2 days.

(21) Appl. No.: 10/612,898

(22) Filed: Jul. 7, 2003

(65) Prior Publication Data

US 2005/0006333 A1 Jan. 13, 2005

(51) Int. Cl.[7] ..... B65D 39/00
(52) U.S. Cl. ..... 215/232; 215/305; 220/375
(58) Field of Search ..... 215/232, 257, 215/305, 306, 353, 355, 292, 298, 363, 364, 249; 220/375, 258.2, 257.2; 222/185.1, 146.6

(56) References Cited

U.S. PATENT DOCUMENTS

| | | | | | |
|---|---|---|---|---|---|
| 1,744,026 | A | * | 1/1930 | Baltzley | 215/298 |
| 2,687,829 | A | | 8/1954 | Horrocks | |
| D200,884 | S | * | 4/1965 | Arthur | D9/438 |
| 4,605,136 | A | | 8/1986 | Debetencourt | |
| 4,789,082 | A | | 12/1988 | Sampson | |
| 4,863,047 | A | * | 9/1989 | Crow | 215/47 |
| 4,869,383 | A | * | 9/1989 | Bahr et al. | 215/232 |
| 4,872,571 | A | * | 10/1989 | Crecelius et al. | 222/541.1 |
| 5,121,845 | A | * | 6/1992 | Blanchard | 215/232 |
| 5,123,570 | A | | 6/1992 | Dubow et al. | |
| 5,156,286 | A | * | 10/1992 | Piccard | 215/232 |
| 5,246,126 | A | * | 9/1993 | Lewis, Jr. | 215/303 |
| 5,353,968 | A | | 10/1994 | Good | |
| 5,372,268 | A | * | 12/1994 | Han | 215/232 |
| D362,185 | S | * | 9/1995 | Ramsey | D9/438 |
| 5,566,859 | A | | 10/1996 | Willis et al. | |
| 5,636,772 | A | | 6/1997 | Poulsen | |
| 5,915,578 | A | * | 6/1999 | Burt | 215/250 |
| 5,947,344 | A | | 9/1999 | Jangaard | |
| 6,364,180 | B1 | | 4/2002 | Cardenas | |
| 2004/0238477 | A1 | * | 12/2004 | Unsworth | |

* cited by examiner

*Primary Examiner*—Lien M. Ngo
(74) *Attorney, Agent, or Firm*—Anthony D. Pellegrini, Esq.

(57) ABSTRACT

A removable sealing device for a standard container having a neck, which allows the container to remain sealed while it is being properly positioned with respect to a receptacle and then to be remotely unsealed after it has been properly positioned with respect to the receptacle, thereby preventing the contents of the container from spilling on or around the receptacle. A method of sealing containers involving dispensing removable membranous seals from a continuous length and attaching the seals to standard containers.

9 Claims, 8 Drawing Sheets

REMOVABLE SEALING DEVICE

BACKGROUND OF THE INVENTION

1. Field of the Invention

This invention relates generally to sealing devices adapted to prevent the escape of fluids or granules from containers, and more particularly to sealing devices which are removable after the containers are properly positioned so as to minimize the spilling of the fluids or granules when transferring same into receptacles.

In the transfer of pourable materials, whether fluid or granular, from a container to a receptacle, spillage often takes place. This is particularly likely to occur if the size of the opening of the container is large in proportion to the size of the opening of the receptacle, or if the working environment renders transfer of the material difficult to effect without spillage. The resulting spillage is wasteful and potentially hazardous, and the cleanup is time consuming. A prime example occurs when automotive motor oil is attempted to be transferred from a container into an automobile engine. In such circumstances the oil flowing from the container may be spilled onto the engine, making a mess and potentially degrading components of the engine or interfering with their function. It may also lead to fire if the oil is spilled in sufficient quantity onto hot engine parts. In another example, in the case of a bakery, flour, baking soda, powdered sugar, and the like may spill when poured from a container into a bin or receptacle. This wastes valuable product, creates extra labor to clean the spill, and may introduce particulate matter into the air, threatening the health of the person doing the pouring as well as others nearby. In yet another example, chemical laboratories in schools or businesses commonly make use of chemical reagents which are purchased in bulk and then transferred from large containers into smaller ones, such as beakers or flasks. Spillage in such cases is particularly hazardous, since many chemical reagents are toxic, as well as producing noxious fumes.

The advantages of utilizing a sealing device adapted to prevent the escape of fluids or granules until the container is properly aligned with the receptacle are many. The use of such devices could prevent motor oil spills by users even on windy days or in the dark; they could reduce material waste and airborne particulates; they could reduce the hazards of handling noxious and toxic chemicals. These and other obvious advantages would accrue to the use of the claimed device.

2. Description of Prior Art

There have been a number of attempts by others to design containers, particularly in the troublesome case of engine oil, which eliminate spillage. These most often involve specially designed containers with features manufactured into the container and/or the cap of the container.

U.S. Pat. No. 2,687,829 (Horrocks), issued Aug. 31, 1954, represents an early attempt to remove a seal after the container has been properly positioned with respect to the receptacle. '829 (Horrocks) involves a device where the neck of the container is adapted to puncture the cap. The disadvantages of this device is the necessity of reconfiguring both the container neck and the cap, and the resulting damage to the cap which prevents it from sealing the container after use.

U.S. Pat. No. 5,123,570 (Dubow, et al.), issued Jun. 23, 1992, involves a frangible seal and a seal rupturing rod attached to the bottom of the container and extending to just below the seal. The seal is broken by applying a sufficient force to the bottom of the container to distort the Bottom inward, thereby forcing the rod through the seal. This design necessitates a modification of the container to incorporate the rod. It also creates a tiny aperture in the seal, which may impede the free flow of contents, especially if the contents are granular rather than fluid. Finally, the materials from which the container may be constructed are limited to those flexible enough to permit distortion of the bottom of the container.

U.S. Pat. No. 5,566,859 (Willis, et al.), issued Oct. 22, 1996, operates on a principal similar to '570 (Dubow). '859 (Willis) involves a frangible seal with a seal-piercing component integrated into the cap. The cap also includes an aperture through which the contents may flow. The disadvantages of this design are several: the cap itself must be redesigned to include the piercing component and the aperture; the seal may be inadvertently pierced during storage or handling; and once the seal is ruptured, the cap, due to the aperture, no longer seals the container.

U.S. Pat. No. 6,364,180 (Cardenas), issued Apr. 2, 2002, also operates on a principal similar to '570 (Dubow), in that the device includes a frangible seal and an integrated seal rupturing component. In '180 (Cardenas), the seal rupturing component is an inner neck situated below the seal; when the outer neck is compressed, the inner neck contacts and ruptures the seal. This design requires a substantial modification to the container and limits the materials from which the container may be constructed.

U.S. Pat. No. 4,789,082 (Sampson), issued Dec. 6, 1988, employs a seal which is removed by applying force to the sides of the container, thereby creating an increase in the internal pressure of the container until such pressure causes the seal to detach from the container. While this invention does not require any modification to a standard container, it does limit the construction of the container to materials which are easily deformable. Moreover, it would not be useful with granule, rather than fluid, contents, as the lateral pressures applied to the sides of the container would not easily translate into increased pressure on the seal. Finally, this invention does not allow the user much control over the release of the seal, as the amount of pressure needed to be applied to the sides of the container may be variable and the ultimate detachment of the seal from the container may be rather explosive, creating the very spillage that the device is intended to prevent. In addition, compression of the container during shipping or handling could inadvertently break the seal.

U.S. Pat. No. 5,353,968 (Good), issued Oct. 11, 1994, operates on a principal similar to '082 (Sampson) in that a force is applied to the sides of the container to create an increase in the internal pressure. '968 (Good) differs from '082 (Sampson) in that the seal itself is designed with weakened areas which give way when the internal pressure is great enough, thereby causing the seal to rupture. This device has all of the disadvantages evident in the '082 (Sampson) invention.

U.S. Pat. No. 5,947,344 (Jangaard), issued Sep. 7, 1999, also operates on a principal similar to '082 (Sampson). '344 (Jangaard) discloses a container with an enlarged chamber formed into the neck, with a plug lodged in the opening at the end of the chamber opposite the exterior opening of the container. The container is required to be constructed of a flexible material. The user dislodges the plug by applying a sufficient force to distort the container, thereby increasing the interior pressure sufficiently to dislodge the plug; the plug remains in the chamber and the fluid flows around it and out of the container. This device has all of the disadvantages evident in the '082 (Sampson) invention, as well as requiring significant modification to the container. In addition, if pressure on the container is released, the plug may return to its original position, stopping the flow of the contents.

U.S. Pat. No. 5,636,772 (Poulsen), issued Jun. 10, 1997, employs a container with an elongated, flexible neck, with a frangible seal attached within the neck. The seal is ruptured when the neck is squeezed with sufficient force to distort its shape. This design requires the container to be modified and limits the materials from which the container may be constructed. It also involves a difficult procedure for attaching the seal to the interior of the elongated neck in the manufacturing process.

U.S. Pat. No. 4,605,136 (Debetencourt), issued Aug. 12, 1986, discloses a seal having a small tab. This invention requires modification to the container neck or to the cap to create a free space to accommodate the tab. Nevertheless, the tab is so short that its utility in remotely removing the seal is minimized.

U.S. Pat. No. 4,872,571 (Crecelius, et al.), issued Oct. 10, 1989, comes closest to solving the problems inherent in the prior art devices. It applies a removable seal to a standard container, with the seal having an elongated tab to facilitate the removal of the seal. Use of the elongated tab provides the user control in removing the seal. However, the container still needs to be modified by creating a channel in the threads of the container in order to accommodate the elongated tab. This need for modification increases the cost of the container and reduces the attractiveness of this device for production purposes. Additionally, the elongated tab is positioned alongside the neck of the container in a manner which is not conducive to easy removal of the seal, thereby necessitating the repositioning of the tab before it can be effectively used. This may present some difficulty to a user, especially if the tab is adhered to the neck of the container, as is taught by the device. Finally, the tab itself may be difficult to grip because of its elongated shape.

The claimed invention addresses all of the problems and deficiencies found in the prior art. The primary advantage is that no modification to the container is required. Containers manufactured of plastic material using a blow-molding process by which manufacture is rendered less expensive than by other forms of molding or shaping of the container may be used. This is especially useful when the container is to be used for dispensing automotive motor oil, as such containers conform to industrial standards as to dimensions, shape and features. However, any other method of manufacture may be used, as well as any kind of material, including rigid materials which would prevent the container from distorting. Other advantages of the claimed invention are that it allows for a controlled removal of the seal, thereby minimizing accidental spillage from unexpected or sudden rupturing of the seal; the claimed invention aligns the remote seal removal mechanism for the convenience of the user; and it retains the seal after it is removed to minimize the creation of litter. The claimed invention is easy and inexpensive to manufacture, and easy to adapt to existing manufacturing processes.

SUMMARY

In one aspect, the invention is directed to a removable sealing device adapted for use with a hollow container suitable for containing fluid or granules, said container comprising a body and a neck, said container having an opening in the neck defined by a rim through which contents of the container may flow, and said container optionally having an external thread or other mechanical detent on the neck suitably adapted to receive a cap with internal threads or other mechanical means for retaining the cap in place on the neck of the container.

In this aspect, the removable sealing device comprises a membranous seal adapted to cover the opening of the container and a sleeve adapted to be positioned over and around the neck of the container. The membranous seal has a sealing component and a tab component. The sealing component is suitably shaped to completely cover the opening in the neck of the container and the rim of the opening. The tab component has a substantially elongated rectangular shape, with an attachment end and a gripping end located opposite the attachment end. The attachment end of the tab component is attached to and integrated with the sealing component such that the tab component is oriented substantially perpendicular to the sealing component. The gripping end of the tab component has a suitable shape so as to make the tab component convenient to grasp. The tab component is folded across the top surface of the sealing component and down the neck of the container. The sleeve is positioned over and around the neck of the container such that the sleeve fits snugly about the neck of the container and over the tab component, holding the tab component in place.

This aspect may also include one or more of the following features: the membranous seal is comprised of multiple layers, with the outer surfaces of the outer layers having reasonably low coefficients of friction; the gripping end of the tab component contains a central aperture, suitably adapted to accommodate a user's finger; the membranous seal further comprises a first crimp and a second crimp which facilitate the folding of the tab component back upon the sealing component and downward along the neck of the container; the sealing component further comprises first and second break lines, formed into the sealing component such that the sealing component is weakened along the first and second break lines yet still retains the ability to provide an unbroken seal over the opening of the neck of the container; the sealing component further comprises first and second notches which facilitate tearing of the sealing component along the first and second break lines; the device further comprising a lever to facilitate rupturing the sealing component; and the device may comprise multiple membranous seals attached to each other in a continuous length with serrations in between to facilitate separation of individual membranous seals.

In another aspect, the invention is directed to a method of sealing containers having been filled with appropriate contents, the method utilizing multiple membranous seals attached to each other in a continuous length.

It is an object of the invention to make the use of existing containers more convenient, less wasteful, and safer, by applying the removable sealing device disclosed herein to existing containers, with no modifications necessary to existing containers or caps, and without the necessity of manufacturing special containers.

It is a further object of the invention to provide for a method of sealing containers which has minimal impact to existing production lines, thereby allowing adaptation of the claimed device to existing uses at little additional cost.

Other features and advantages of the invention are described below.

DESCRIPTION OF THE INVENTION

The invention disclosed herein comprises a removable seal device for a container 2 of standard manufacture which will allow the user to unseal the container 2 after it is properly positioned with respect to a receptacle 4 so as to minimize spillage. In the preferred embodiment, the removable seal device is used on containers of automotive motor oil.

Figure 1:
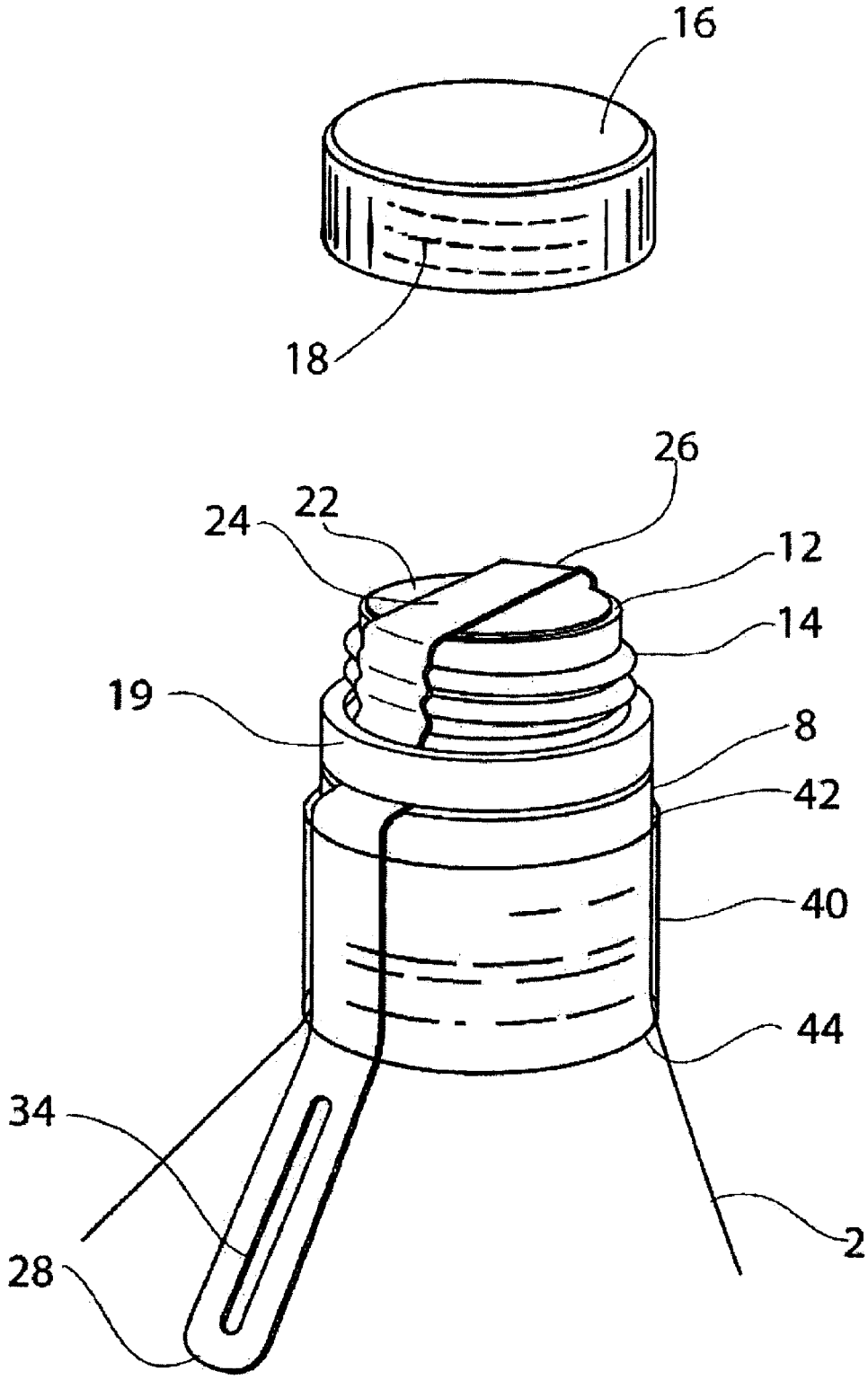
FIG. 1 is a perspective view of one embodiment of the device.

FIG. 1 shows a perspective view of one embodiment of the device. The device is adapted to be used with any standard container 2 having the following characteristics: the container 2 must be suitable for containing fluid 6 or granules; the container 2 must have a neck 8; the neck 8 must have an opening 10 defined by a rim 12 through which contents of the container 2 may flow; the container 2 may have a cap 16 suitable for sealing the container 2; the neck 8 may have external threads 14 or other mechanical detent suitably adapted to receive the cap 16; the cap 16 may have internal threads 18 or other mechanical means for retaining the cap 16 in place on the neck 8 of the container 2; and the cap 16 may employ a standard tamper-evident locking ring 19. Neither the cap 16 nor the tamper-evident locking ring 19 are required for full functionality of the device.

The removable sealing device is comprised of a membranous seal 20 and a sleeve 40. The membranous seal 20 is constructed of any flexible, frangible material having a reasonably low coefficient of friction and sufficient tensile strength to perform its sealing and unsealing functions. In one embodiment the membranous seal 20 may be comprised of multiple layers, with the outer surfaces of the outer layers having reasonably low coefficients of friction.

Figure 5:
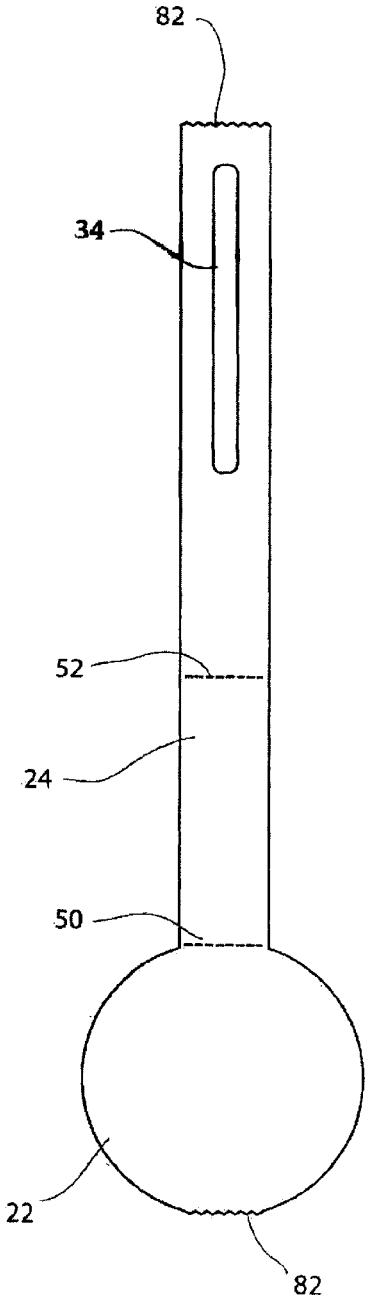
FIG. 5 is a planar view of the membranous seal showing the location of the central aperture, the optional crimps, and the optional serrations.

The membranous seal 20 is comprised of a sealing component 22 and a tab component 24, whereby the sealing component 22 is integrated with the tab component 24, as shown in FIG. 5. The sealing component 22 is suitably shaped to completely cover the opening 10 in the neck 8 of the container 2 and the rim 12 of the opening 10. In the preferred embodiment the sealing component 22 is circular. The tab component 24 has a substantially elongated rectangular shape, with an attachment end 26 and a gripping end 28 located opposite the attachment end 26, and with a first edge 30 and a second edge 32 opposite the first edge 30. The tab component 24 may be of any length or width that is convenient and which allows the user to conveniently grasp the tab component 24 after the container 2 is properly positioned with respect to a receptacle 4 in preparation for pouring its contents into the receptacle 4.

The tab component 24 extends from the sealing component 22, with its attachment end 26 adjacent to the sealing component 22, and the tab component 24 oriented substantially perpendicular to the sealing component 22. In one embodiment, the gripping end 28 of the tab component 24 has a greater width than the width of the remainder of the tab component 24, thereby forming a spatulate handle convenient for gripping. This shaping of the gripping end 28 improves the ability of the user to properly manipulate the device, since the low coefficient of friction of the material comprising the tab component 24 may otherwise be overly slippery. In another embodiment, the gripping end 28 may be of any other suitable shape so as to make the tab component 24 convenient to grasp. In yet another embodiment, the gripping end 28 of the tab component 24 contains a central aperture 34, suitably adapted to accommodate a user's finger 36. When a user's finger 36 is inserted into the aperture 34, the gripping end 28 becomes a pull loop, thereby making the tab component 24 even easier to grasp and making operation of the device reliable in all conditions.

The sealing component 22 is removably attached to the rim 12 of the neck 8 of the container 2 using an adhesive or a heat-based process, sufficient to make a seal, thereby totally covering the opening 10 in the neck 8. Details of the method to adhere the sealing component 22 to the neck 8 of the container 2 are well known to those skilled in the art.

The sleeve 40 is comprised of a flexible material having a reasonably low coefficient of friction. The sleeve 40 has openings 42,44 at either end and is suitably adapted to be positioned over and around the neck 8 of the container 2 such that the sleeve 40 fits snugly about the neck 8 of the container 2 and below the external threads 14 on the neck 8.

The tab component 24 of the membranous seal 20 is folded back upon the sealing component 22, then folded downward along the neck 8 of the container 2 and over the external threads 14 on the neck 8. The sleeve 40 is placed over the neck 8 such that the tab component 24 is disposed between the sleeve 40 and the neck 8, with the gripping end 28 of the tab component 24 extending from the lower opening 44 of the sleeve 40. The sleeve 40 serves to retain the tab component 24 in position and protect it from damage during storage and handling, as well as to provide a guide for the tab component 24 during removal of the membranous seal 20.

Figure 2:
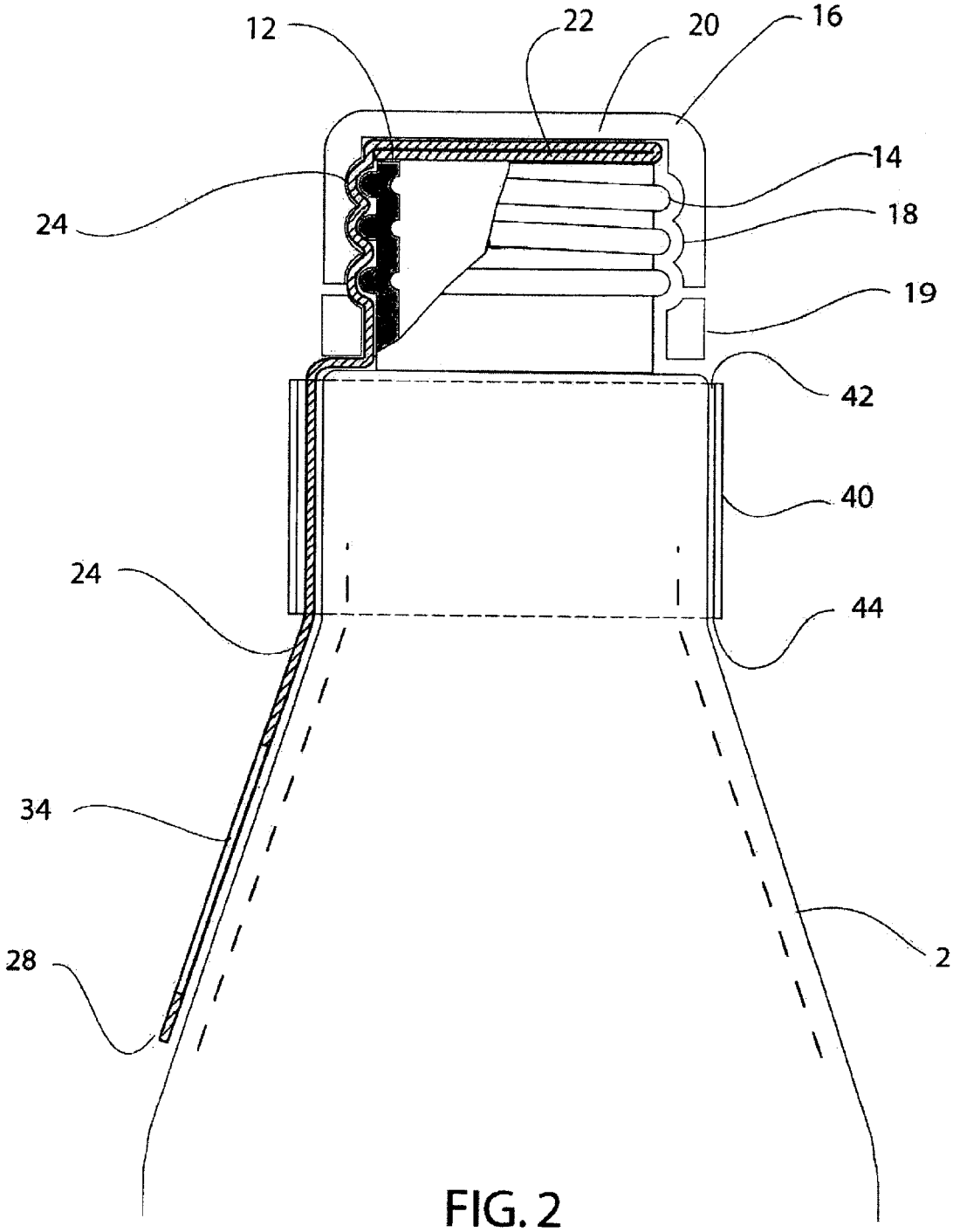
FIG. 2 is a cut away side view showing details of the arrangement of components of the device in one embodiment.

When utilized, the cap 16 is placed onto the neck 8, such that the tab component 24 is disposed between the internal threads 18 of the cap 16 and the external threads 14 of the neck 8. The low coefficient of friction of the material comprising the tab component 24 allows the cap 16 to be placed onto the neck 8 without necessitating any modification to the cap 16 or neck 8, as the cap 16 glides easily over the tab component 24 and is secured to the neck 8 without loss of sealing effectiveness or impedance in use. The cap 16, when placed tightly on the neck 8 of the container 2, also serves to secure the tab component 24 in place and prevents the membranous seal 20 from being prematurely or accidentally removed. FIG. 2 shows the foregoing arrangement of the components of the device in greater detail.

Figure 3:
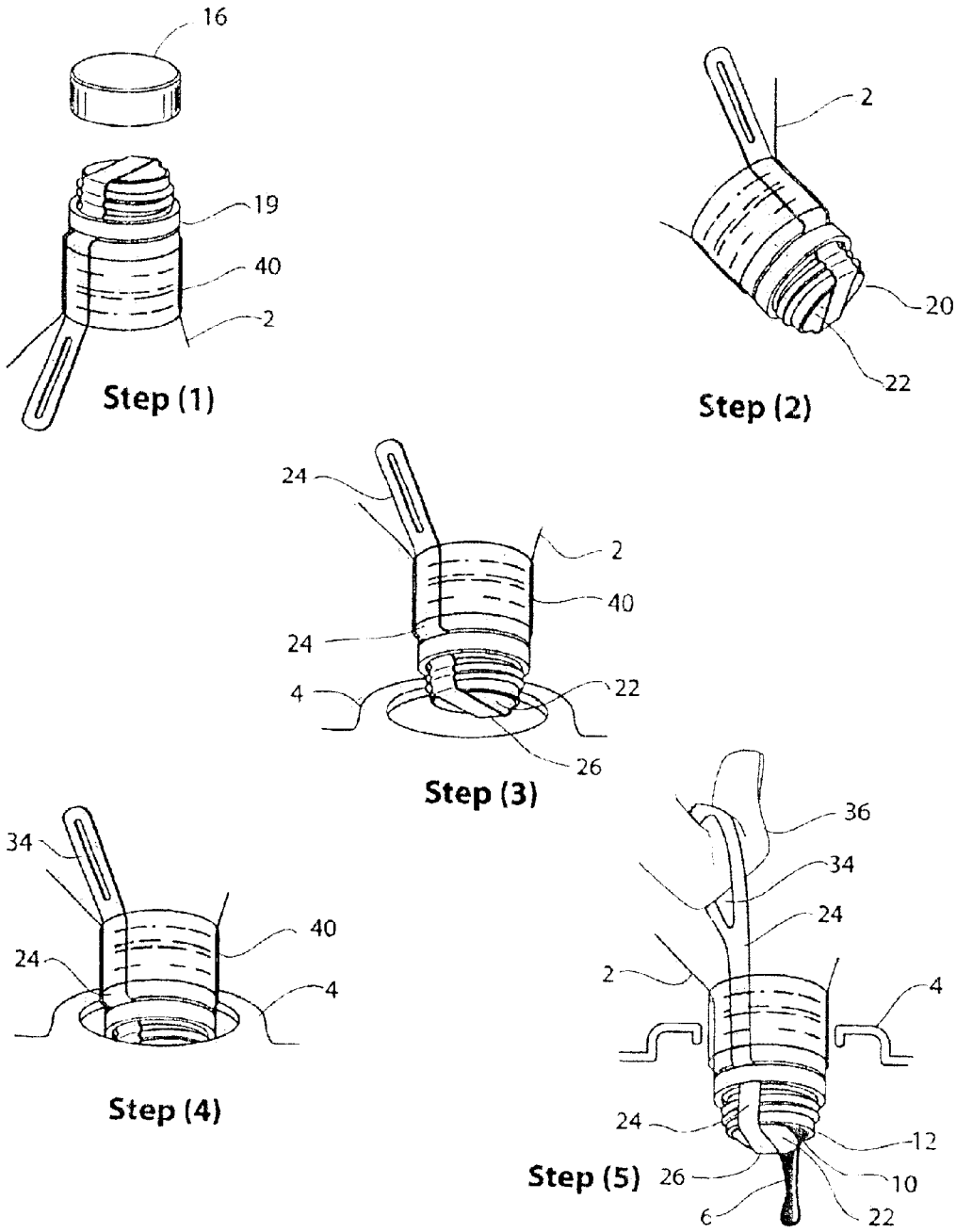
FIG. 3 shows a method of using the device to transfer fluid from a container into a receptacle.

FIG. 3 shows how the removable sealing device may be used in one embodiment. In Step 1, the cap 16 is removed from the container 2. The removable sealing device will work unimpeded even if a tamper-evident locking ring 19 is used with the cap 16. In Steps 2–4, the container 2 is properly positioned with respect to the receptacle 4. During this positioning the uncapped container 2 remains sealed by the sealing component 22 of the membranous seal 20. In the case where the container 2 contains automotive motor oil and the receptacle 4 is an automobile engine crankcase, proper positioning of the container 2 would involve inserting the neck 8 into the opening of the crankcase. (See FIG. 3, Steps 3–4.) The sleeve 40 serves to protect the tab component 24 from the potentially sharp interior edges of the opening of the receptacle 4. The sleeve 40 also properly aligns the tab component 24 for the user. Because the tab component 24 has been folded over the sealing component 22 and lays against the side of the neck 8 opposite the attachment end 26, exerting an upward force on the tab component 24 when the container 2 is inverted causes the sealing component 22 to easily peel or tear away from the rim 12 of the neck 8, thereby uncovering the opening 10 in the neck 8 and allowing the contents of the container 2 to flow out of the container 2. (See FIG. 3, Step 5.) The sleeve 40 serves to direct the force on the tab component 24 in the proper direction regardless of the orientation of the container 2. However, even if the sleeve 40 is removed, or if the tab component 24 is extracted from between the sleeve 40 and the neck 8 of the container 2, the membranous seal 20 may be removed by applying a suitable force to the tab component 24. The sleeve 40 also secures the membranous seal 20 to the container 2 once the container 2 has been unsealed, thereby reducing the likelihood of litter.

Figure 4:
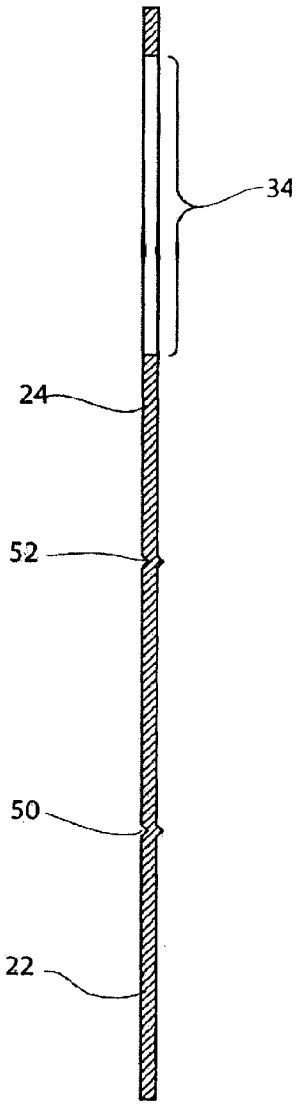
FIG. 4 is a cross-section side view of the membranous seal, indicating the location of the central aperture and the optional crimps.

In one embodiment, the membranous seal 20 further comprises a first crimp 50 and a second crimp 52, each of which is suitably adapted to facilitate the folding of the tab component 24 back upon the sealing component 22 and downward along the neck 8 of the container 2. The first crimp 50 extends laterally across the width of the tab component 24 from the first edge 30 to the second edge 32 and positioned where the attachment end 26 of the tab component 24 meets the sealing component 22. The second crimp 52 extends laterally across the width of the tab component 24 from the first edge 30 to the second edge 32 and is positioned between the first crimp 50 and the gripping end 28 of the tab component 24 such that the distance between the first crimp 50 and the second crimp 52 is substantially identical to the diameter of the opening 10 of the neck 8 of the container 2. The foregoing arrangement is depicted in FIGS. 4 and 5.

Figure 7:
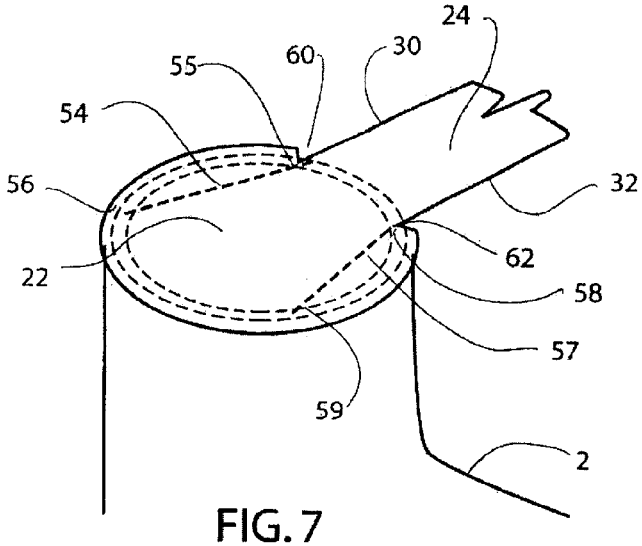
FIG. 7 is a perspective view showing an alternate means of breaking the sealing component of the container by use of weakened zones in the sealing component.
Figure 8:
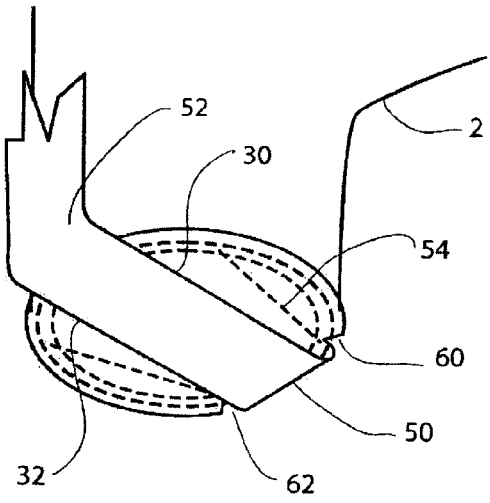
FIG. 8 is a perspective view showing the use of the device when employing an alternate means of breaking the sealing component of the container as depicted in FIG. 7.
Figure 9:
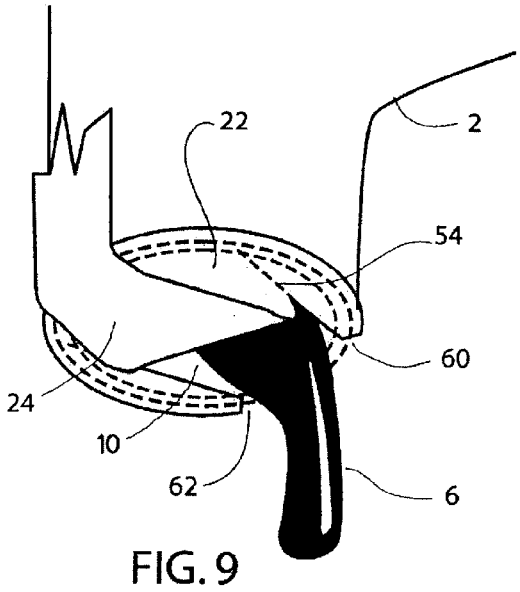
FIG. 9 is a perspective view showing the use of the device when employing an alternate means of breaking the sealing component of the container as depicted in FIG. 7.

In another embodiment, the sealing component 22 further comprises a first break line 54 and a second break line 57. These break lines 54,57 represent weakened areas in the membranous material comprising the sealing component 22, thereby facilitating tearing of the sealing component 22 during the removal operation. However, the break lines 54,57 are suitably adapted so as to not compromise the ability of the sealing component 22 to provide an unbroken seal over the opening 10 of the neck 8 of the container 2. The first break line 54 is formed into the sealing component 22 and has a first end 55 and a second end 56. The first end 55 of the first break line 54 is adjacent to the first edge 30 of the tab component 24 where the tab component 24 meets the sealing component 22. The first break line 54 extends across and transects the sealing component 22, with the second end 56 of the first break line 54 located proximate to an edge of the sealing component 22 opposite the tab component 24. The second break line 57 is formed into the sealing component 22 and has a first end 58 and a second end 59. The first end 58 of the second break line 57 is adjacent to the second edge 32 of the tab component 24 where the tab component 24 meets the sealing component 22. The second break line 57 extends across and transects the sealing component 22, with the second end 59 of the second break line 57 located proximate to an edge of the sealing component 22 opposite the tab component 24. The first break line 54 and the second break line 57 diverge as they extend across the sealing component 22, such that the distance between the second ends 56,59 of the first and second break lines 54,57 is greater than the distance between the first ends 55,58 of the first and second break lines 54,57. The application of a suitable force to the tab component 24 initiates the tearing of the sealing component 22 along the first and second break lines 54,57. This embodiment may further comprise optional first and second notches 60, 62 to facilitate the tearing of the sealing component 22 along the first and second break lines 54,57. The first notch 60 is located adjacent to the first end 55 of the first break line 54 and the second notch 62 is located adjacent to the first end 58 of the second break line 57. FIG. 7 shows the approximate location of the first and second break lines 54,57 and the first and second notches 60,62 on the sealing component 22. FIGS. 8 and 9 depict operation of this embodiment.

Figure 10:
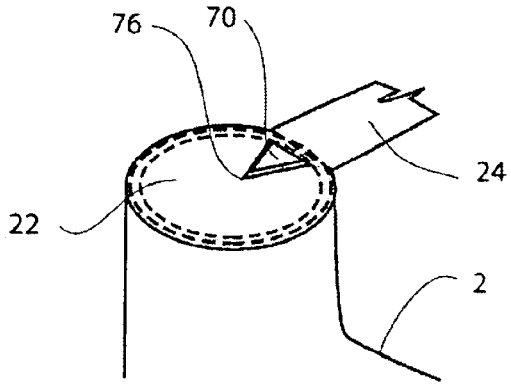
FIG. 10 is a perspective view showing an alternate means of breaking the sealing component of the container by use of a lever.
Figure 11:
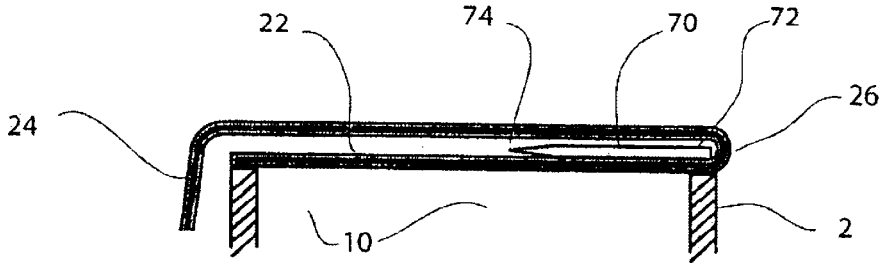
FIG. 11 is a cut away side view showing the components of the alternate means of breaking the sealing component of the container as depicted in FIG. 10.
Figure 12:
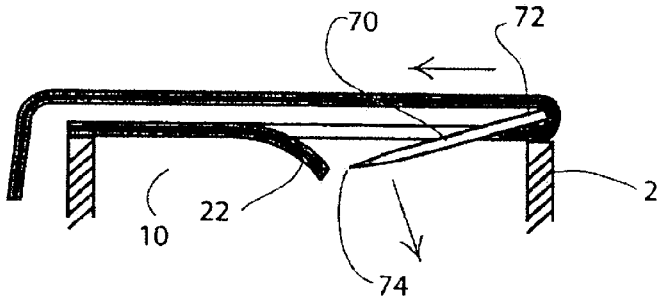
FIG. 12 is a cut away side view showing the use of the device when employing the alternate means of breaking the sealing component of the container as depicted in FIG. 10.

In the event the device is used on a container 2 of sufficient size so as to require a particularly durable membranous seal 20 such that ordinary manual strength may be impractical or insufficient to effect the removal of the membranous seal 20, an optional lever 70 may be attached to the membranous seal 20 to assist in applying sufficient force in a direction away from the opening 10 of the container 2 and toward the base of the container 2, such that the action of the lever 70 punctures the sealing component 22 of the membranous seal 20. The lever 70 must be constructed of a substantially rigid material. It has a first end 72 and a second end 74. As shown in FIGS. 10 and 11, the lever 70 is attached to the sealing component 22 with the first end 72 of the lever 70 positioned adjacent to the attachment end 26 of the tab component 24 and the second end 74 of the lever 70 positioned over the sealing component 22. When an upward or lateral force is applied to the tab component 24 the first end 72 of the lever 70 is lifted upward, causing the second end 74 of the lever 70 to be forced downward, rupturing the sealing component 22. (See FIG. 12.) In one embodiment, the second end 74 of the lever 70 is shaped into a point 76 to facilitate the lever's 70 ability to rupture the sealing component 22.

Figure 6:
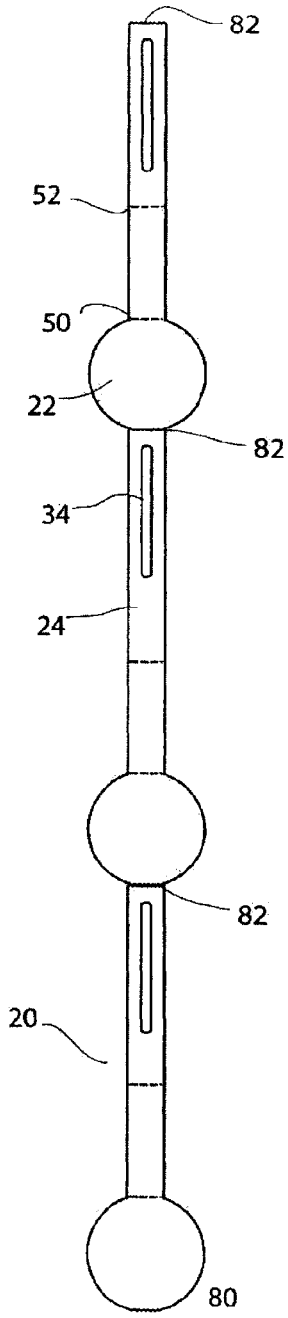
FIG. 6 is a planar view of multiple membranous seals attached in a continuous length as a suggested method of manufacture.

To facilitate the adaptation of the device to existing manufacturing processes, multiple membranous seals 20 may be attached to each other in a continuous length 80, as shown in FIG. 6. The gripping end 28 of the tab component 24 of each membranous seal 20 would be attached to the sealing component 22 of an adjacent membranous seal 20. Serrations 82 would be formed at the junction of each membranous seal 20 with each adjacent membranous seal 20 to facilitate separation of individual membranous seals 20. When unrolled, the membranous seals 20 would be oriented with respect to each other such that their corresponding tab components 24 are aligned along a single axis. This method of manufacture of the membranous seals 20 is made practical by the simple shapes of the sealing component 22 and the tab component 24. It is possible to cut membranous material of various compositions into such shapes using a continuous die-cutting process well-known by those skilled in the art, and to store the results in a continuous length 80 prior to use in a manufacturing assembly line. Means for feeding the shapes in a continuous length 80 during manufacture are also well-known.

Figure 13:
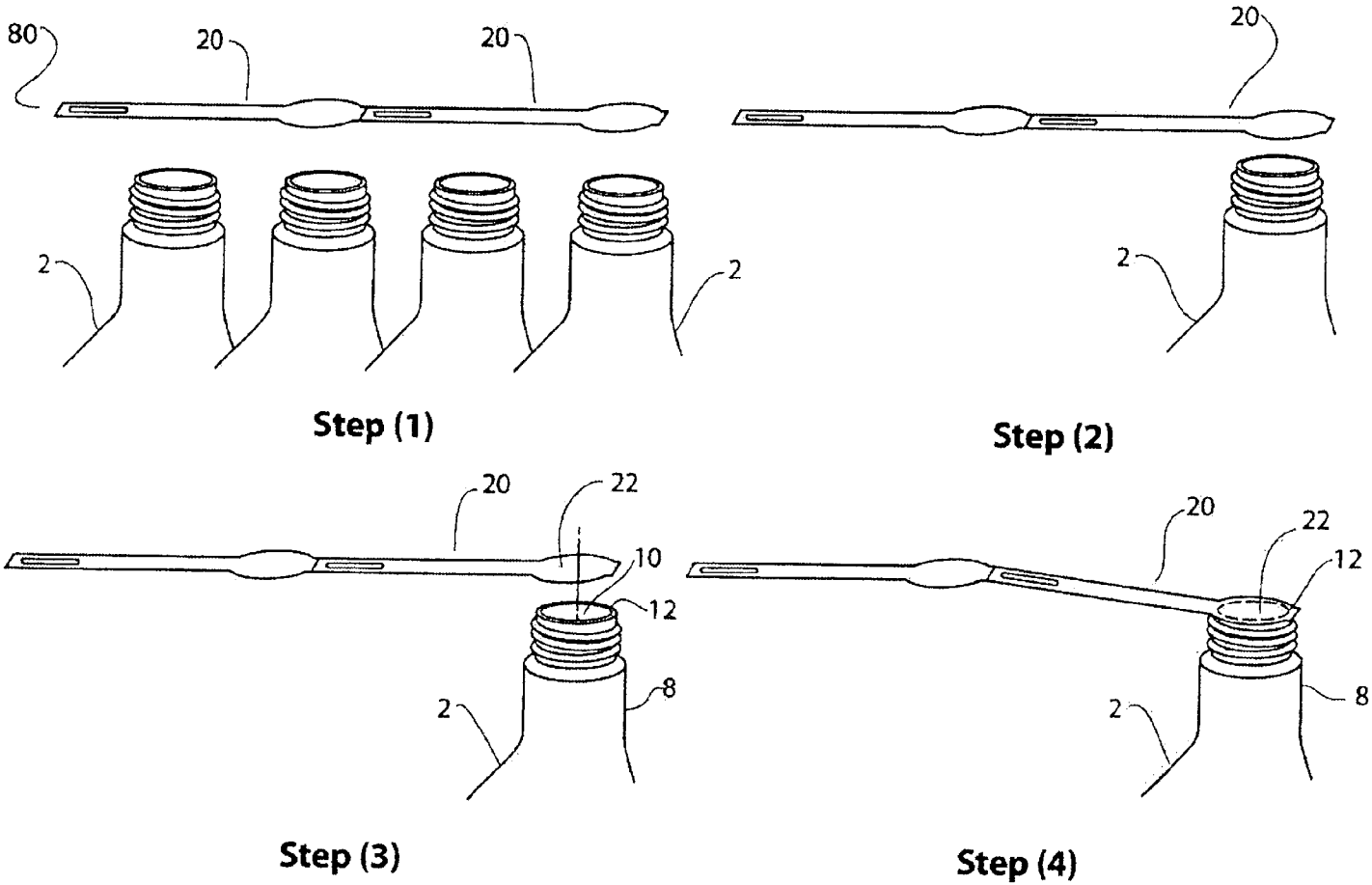
FIG. 13 shows steps one through four of the claimed method for sealing containers using the device.
Figure 14:
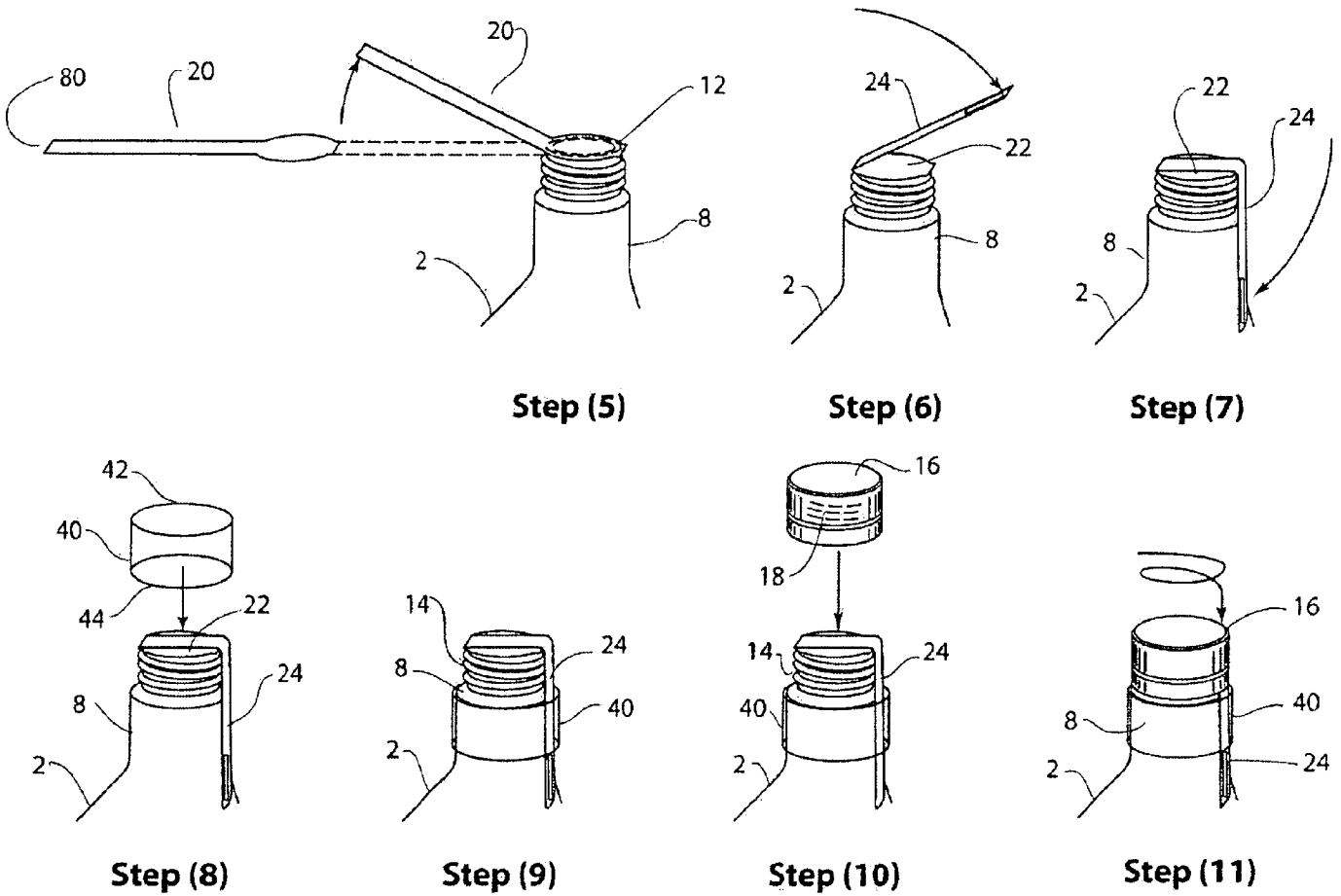
FIG. 14 shows steps five through eleven of the claimed method for sealing containers using the device.

The invention also discloses a method of sealing containers using the removable sealing device disclosed herein, configured with a plurality of membranous seals 20 attached to each other in a continuous length 80. As shown in FIGS. 13 and 14, the method involves the use of a plurality of containers, each container 2 having the characteristics described above, with each container 2 being filled with its intended contents; a plurality of membranous seals 20 configured in a continuous length 80, having the characteristics described above; a plurality of sleeves 40, each sleeve 40 having the characteristics described above; a plurality of caps 16, each cap 16 having the characteristics described above; a means suitably adapted to convey the plurality of containers 2 in an orderly process, such as a conveyor belt as is typically found in a manufacturing assembly line; a means suitably adapted for aligning a terminal membranous seal 20 of the continuous length 80 of membranous seals 20 over a container 2, with such means being well-known in the art; a means suitably adapted for attaching the terminal membranous seal 20 to the rim 12 of the container 2, said means employing an adhesive or a heating process as such means are well-known in the art; a means suitably adapted for separating the newly attached terminal membranous seal 20 from the remaining continuous length 80 of membranous seals 20, said means facilitated by the serrations 82 formed into and between the membranous seals 20 of the continuous length 80; a means suitably adapted for folding the tab component 24 of each attached membranous seal 20 over the sealing component 22 of that membranous seal 20 and down along the neck 8 of the container 2 to which the membranous seal 20 is attached; a means suitably adapted for aligning one of the plurality of sleeves 40 over the neck 8 of the container 2 and for positioning that sleeve 40 over the neck 8 of the container 2 and over the tab component 24 of the membranous seal 20 attached to the container 2 such that the sleeve 40 fits snugly about the neck 8 of the container 2 and below the external threads 14 or other mechanical detents on the neck 8; and a means suitably adapted for attaching one of the plurality of caps 16 to a container 2 such that the cap 16 is securely attached to the container 2 with the tab component 24 of the membranous seal 20 attached to that container 2 disposed between the internal threads 18 or other mechanical means of the cap 16 and the external threads 14 other mechanical detent of the neck 8 of the container 2.

The method uses the foregoing elements in the following sequence of steps:

(1) the containers 2 are conveyed in an orderly process by the means suitably adapted to convey the plurality of containers 2. For each container 2:

(2) the container 2 is positioned by the means suitably adapted to convey the plurality of containers 2 beneath the means suitably adapted for aligning a terminal membranous seal 20 of the continuous length 80 of membranous seals 20 over a container 2, in anticipation of the container 2 receiving the membranous seal 20;

(3) one of the plurality of membranous seals 20 joined together in a continuous length 80 is positioned above the container 2 by the means suitably adapted for aligning a terminal membranous seal 20 of the continuous length 80 of membranous seals 20 over a container 2, such that the sealing component 22 of the membranous seal 20 is aligned with the opening 10 in the neck 8 of the container 2;

(4) the membranous seal 20 is attached to the rim 12 of the neck 8 of the container 2 by the means suitably adapted for attaching the terminal membranous seal 20 to the rim 12 of the container 2;

(5) the membranous seal 20 is separated from the remaining plurality of membranous seals 20 of the continuous length 80 by the means suitably adapted for separating the newly attached terminal membranous seal 20 from the remaining continuous length 80 of membranous seals 20;

(6) the container 2 is positioned by the means suitably adapted to convey the plurality of containers 2 beneath the means suitably adapted for folding the tab component 24 of each attached membranous seal 20, in anticipation of the tab component 24 being folded;

(7) the tab component 24 of the attached membranous seal 20 is folded over the sealing component 22 of the membranous seal 20 and folded down along the neck 8 of the container 2 by the means suitably adapted for folding the tab component 24 of each attached membranous seal 20 over the sealing component 22 of that membranous seal 20 and down along the neck 8 of the container 2;

(8) the container 2 is positioned by the means suitably adapted to convey the plurality of containers 2 beneath the means suitably adapted for aligning one of the plurality of sleeves 40 over the neck 8 of the container 2 in anticipation of positioning a sleeve 40 over the neck 8 of the container 2 and over the tab component 24 of the membranous seal 20;

(9) one of the plurality of sleeves 40 is aligned over the neck 8 of the container 2 and positioned over the neck 8 of the container 2 and over the tab component 24 of the membranous seal 20 by the means suitably adapted for aligning one of the plurality of sleeves 40 over the neck 8 of the container 2 and for positioning that sleeve 40 over the neck 8 of the container 2 and over the tab component 24 of the membranous seal 20, such that the sleeve 40 fits snugly about the neck 8 of the container 2 and below the external threads 14 or other mechanical detents on the neck 8 of the container 2;

(10) the container 2 is positioned by the means suitably adapted to convey the plurality of containers 2 beneath the means suitably adapted for attaching one of the plurality of caps 16 to a container 2 in anticipation of receiving a cap 16; and

(11) one of the plurality of caps 16 is attached to the container 2 by the means suitably adapted for attaching one of the plurality of caps 16 to a container 2 such that the cap 16 is securely attached to the container 2 with the tab component 24 of the membranous seal 20 attached to that container 2 disposed between the internal threads 18 or other mechanical means of the cap 16 and the external threads 14 other mechanical detent of the neck 8 of the container 2.

The foregoing method is easily and readily adapted to existing manufacturing lines, thus enabling the method and the device disclosed herein to be adopted in existing manufacturing lines with little cost to the manufacturer. Other embodiments not specifically set forth herein are also within the scope of the following claims.

What is claimed is:

1. A hollow container suitable for containing fluid or granules, said container comprising a body and a neck, and having an opening in the neck defined by a rim through which contents of the container may flow, said container optionally having an external thread or other mechanical detent on the neck suitably adapted to receive a cap with internal threads or other mechanical means for retaining the cap in place on the neck of the container, and a removable sealing device, said device comprised of a membranous seal, comprised of a flexible, frangible material having a reasonably low coefficient of friction, said membranous seal having a sealing component and a tab component, with the sealing component suitably shaped to completely cover the opening in the neck of the container and the rim of the opening, and with the tab component having a substantially elongated rectangular shape, with an attachment end and a gripping end located opposite the attachment end, and with a first edge and a second edge opposite the first edge, the attachment end of the tab component attached to and integrated with the sealing component such that the tab component is oriented substantially perpendicular to the sealing component, and the gripping end of the tab component having a greater width than the width of the remainder of the tab component or having any other suitable shape so as to make the tab component convenient to grasp, and a sleeve, comprised of a flexible material having a reasonably low coefficient of friction, said sleeve having openings at either end and being suitably adapted to be positioned over and around the neck of the container such that the sleeve fits snugly about the neck of the container and below the external thread or other mechanical detent on the neck;

whereby the tab component is folded back upon the sealing component, then folded downward along the neck of the container and over the external thread or other mechanical detent on the neck, such that the tab component is positioned between the sleeve and the neck of the container with the gripping end of the tab component extending from the lower opening of the sleeve.

2. The device of claim 1, wherein the membranous seal is comprised of multiple layers, with the outer surfaces of the outer layers having reasonably low coefficients of friction.

3. The device of claim 1, wherein the gripping end of the tab component contains a central aperture, suitably adapted to accommodate a user's finger.

4. The device of claim 1, wherein the membranous seal further comprises a first crimp, extending laterally across the width of the tab component from the first edge to the second edge and positioned where the attachment end of the tab component meets the sealing component; and a second crimp, extending laterally across the width of the tab component from the first edge to the second edge and positioned between the first crimp and the gripping end of the tab component such that the distance between the first crimp and the second crimp is substantially identical to the diameter of the opening of the neck of the container;

whereby the first crimp and the second crimp facilitate the folding of the tab component back upon the sealing component and downward along the neck of the container.

5. The device of claim 1, wherein the sealing component further comprises a first break line, having a first end and a second end, formed into the sealing component such that the sealing component is weakened along the first break line yet still retains the ability to provide an unbroken seal over the opening of the neck of the container; and a second break line, having a first end and a second end, formed into the sealing component such that the sealing component is weakened along the second break line yet still retains the ability to provide an unbroken seal over the opening of the neck of the container;

whereby the first end of the first break line is adjacent to the first edge of the tab component and the first break line extends across and transects the sealing component, and the first end of the second break line is adjacent to the second edge of the tab component and the second break line extends across and transects the sealing component, with the first break line and the second break line diverging as they extend across the sealing component such that the distance between the second ends of the first and second break lines is greater than the distance between the first ends of the first and second break lines.

6. The device of claim 5, wherein the sealing component further comprises a first notch located adjacent to the first end of the first break line; and a second notch located adjacent to the first end of the second break line;

whereby the first notch and the second notch facilitate tearing of the sealing component along the first and second break lines when an upward or lateral force is applied to the tab component.

7. The device of claim 1, further comprising a lever, constructed of a substantially rigid material and having a first end and a second end, said lever being attached to the sealing component with the first end of the lever positioned adjacent to the attachment end of the tab component and the second end of the lever positioned over the sealing component, such that the first end of the lever is lifted upward when an upward or lateral force is applied to the tab component, causing the second end of the lever to be forced downward, rupturing the sealing component.

8. The device of claim 7, wherein the second end of the lever is shaped into a point to facilitate the lever's ability to rupture the sealing component.

9. The device of claim 1, further comprising multiple membranous seals, said membranous seals joined together in a continuous length, with the gripping end of the tab component of each membranous seal attached to the sealing component of an adjacent membranous seal, and with serrations formed at the junction of each membranous seal with each adjacent membranous seal.

* * * * *